US006200094B1

(12) United States Patent
Skoch et al.

(10) Patent No.: US 6,200,094 B1
(45) Date of Patent: Mar. 13, 2001

(54) WAVE AUGMENTED DIFFUSER FOR CENTRIFUGAL COMPRESSOR

(75) Inventors: Gary J. Skoch, Chardon; Daniel E. Paxson, Parma Heights, both of OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/350,207

(22) Filed: Jun. 18, 1999

(51) Int. Cl.[7] ..... F04D 29/44

(52) U.S. Cl. ..... 415/208.2; 415/208.4; 415/211.1; 415/211.2; 415/914

(58) Field of Search ..... 415/208.2, 208.3, 415/208.4, 211.1, 211.2, 914

(56) References Cited

U.S. PATENT DOCUMENTS

| | | | | |
|---|---|---|---|---|
| 2,210,155 | * | 8/1940 | Szydlowski et al. | 415/208.4 |
| 3,861,826 | * | 1/1975 | Dean, Jr. | 415/211 |
| 4,455,121 | * | 6/1984 | Jen | 415/143 |
| 4,527,947 | | 7/1985 | Kirtland . | |
| 4,737,071 | | 4/1988 | Horn, Jr. . | |
| 4,854,126 | * | 8/1989 | Chevis et al. | 60/726 |
| 4,877,370 | | 10/1989 | Nakagawa et al. . | |
| 4,877,373 | | 10/1989 | Bundukwalla . | |
| 5,385,447 | | 1/1995 | Geister . | |
| 5,417,547 | | 5/1995 | Harada . | |
| 5,516,263 | | 5/1996 | Nishida et al. . | |
| 5,529,457 | | 6/1996 | Terasaki et al. . | |
| 5,555,721 | * | 9/1996 | Bourneuf et al. | 60/39.75 |
| 5,595,473 | | 1/1997 | Nagaoka et al. . | |
| 5,611,664 | | 3/1997 | Haugen . | |
| 5,618,162 | * | 4/1997 | Chan et al. | 415/206 |
| 5,669,756 | | 9/1997 | Brasz . | |
| 5,704,211 | | 1/1998 | Hatfield . | |
| 5,709,531 | | 1/1998 | Nishida et al. . | |
| 5,730,580 | | 3/1998 | Japikse . | |

* cited by examiner

*Primary Examiner*—Edward K. Look
*Assistant Examiner*—Ninh Nguyen
(74) *Attorney, Agent, or Firm*—Kent N. Stone

(57) ABSTRACT

A wave augmented diffuser for a centrifugal compressor surrounds the outlet of an impeller that rotates on a drive shaft having an axis of rotation. The impeller brings flow in in an axial direction and imparts kinetic energy to the flow discharging it in radial and tangential directions. The flow is discharged into a plurality of circumferentially disposed wave chambers. The wave chambers are periodically opened and closed by a rotary valve such that the flow through the diffuser is unsteady. The valve includes a plurality of valve openings that are periodically brought into and out of fluid communication with the wave chambers. When the wave chambers are closed, a reflected compression wave moves upstream towards the diffuser bringing the flow into the wave chamber to rest. This action recovers the kinetic energy from the flow and limits any boundary layer growth. The flow is then discharged in an axial direction through an opening in the valve plate when the valve plate is rotated to an open position. The diffuser thus efficiently raises the static pressure of the fluid and discharges an axially directed flow at a radius that is predominantly below the maximum radius of the diffuser.

15 Claims, 9 Drawing Sheets

WAVE AUGMENTED DIFFUSER FOR CENTRIFUGAL COMPRESSOR

BACKGROUND OF THE INVENTION

1. Technical Field

This invention generally relates to diffusers and, more particularly, to a diffuser used in a centrifugal compressor. Specifically, the present invention relates to a diffuser having a valve that selectively opens and closes the outlets of the diffuser to create an unsteady wave pattern that will simultaneously diffuse a centrifugal impeller outflow and turn it to an axial direction.

2. Background Information

A centrifugal compressor employs an impeller that rotates inside a stationary flowpath that is typically formed by an inlet, a shroud, a diffuser, and a discharge duct. The impeller draws a stream of gas through the inlet in a direction that is generally parallel to the axis of rotation of the impeller. A plurality of impeller blades then act upon the stream to impart kinetic energy to the stream. The stream exits the impeller in a direction that is orthogonal or substantially orthogonal to the impeller's axis of rotation. The diffuser then acts on the stream to convert the kinetic energy of the stream to static pressure before discharging the flow to a duct. Typically, the flow discharged from the diffuser must be redirected to a direction substantially parallel to the axis of rotation of the impeller before being delivered to subsequent components.

The flow discharging from centrifugal impeller has significant velocity components in the tangential and radial directions. The tangential velocity component is primarily a result of work input by the impeller. The radial component is a function of the mass moving through the impeller and the flow path area and static conditions at the impeller trailing edge.

Conventional diffusers operate in a steady flow environment and employ conservation of mass and momentum principles to recover kinetic energy from the impeller discharge flow by reducing the absolute Mach number of the flow. As Mach number is reduced, the static pressure and density of the flow increase. To accomplish Mach number reduction, the diffuser accepts the impeller discharge flow and directs it through a single or plurality of passages wherein the area and radius increase with the distance along the passage.

Upon discharge from the diffuser, the flow still possesses radial and tangential components of velocity. These components are redirected to an axial direction through a high-radius duct as the flow is delivered to subsequent components. De-swirl vanes may be located in this duct to remove some of the remaining tangential velocity component.

Many configurations are known for steady flow diffusers. For instance, steady flow diffusers are known in the art as vaned diffusers, vane-island diffusers, channel diffusers, cascade diffusers, pipe diffusers, conical diffusers, vaneless diffusers, scroll diffusers, volute diffusers, and the like.

Vaned, vane-island, channel, and cascade diffusers use flat, wedge-shaped, or curved vanes that are arranged to form channels within the diffuser. Each vane provides a pressure surface for one channel and a suction surface for an adjacent channel. The channels are bounded on the two remaining sides by generally parallel solid surfaces that are typically referred to as the hub and shroud surfaces. The two remaining sides of the channel are open so that flow can enter and exit the channel. The pressure and suction surfaces typically diverge to create an increasing flow area along the channel. The increasing area causes a decrease in Mach number as flow moves through the passage. The centerline of each channel is aligned with the absolute angle of impeller discharge flow produced at a particular operating condition. In some situations, the vanes may be rotated so that channel alignment can be maintained at several operating conditions.

The pipe diffuser, or conical diffuser, is a channel-type diffuser where the channel cross section has a circular rather than rectangular shape. The circular cross section in combination with increasing area along the passage gives each passage a conical shape. The leading edge of each passage typically intersects with the leading edge of an adjacent passage creating a scalloped profile.

The flow through a vaneless diffuser is bounded on only the two sides adjacent to the impeller hub and shroud surfaces. The vaneless diffuser is essentially a channel diffuser without vanes. No attempt is made to contain radial or tangential velocity components in a vaneless diffuser. Instead, the flow is allowed to swirl out to higher radii and the tangential velocity is reduced through conservation of angular momentum. Radial velocity is reduced as flow area increases with radius.

The volute or scroll diffuser is formed by a single channel wrapped about the impeller in the direction of rotation. The cross-sectional area of the channel increases with the distance along the flow path. As in the vaneless diffuser, volute diffusers are based on the premise that the angular momentum of the flow remains constant as radius increases. However, flow in the volute diffuser is bounded in all directions except the direction that follows the helical path leading away from the impeller.

The efficiency of any process that uses a centrifugal compressor depends at least partially on the efficiency of the compressor. The efficiency of the compressor depends at least partially on the efficiency of the diffuser in the compressor. A diffuser that loses pressure when converting the kinetic energy of the stream lowers the efficiency of the compressor and thus the efficiency of the process that employs the compressor. Most applications that require centrifugal compressors, especially aircraft gas turbine engine applications, place a size constraint on the compressor. These size limitations cause the outside diameter of the diffuser and discharge duct to be limited. Diffuser performance tends to vary inversely with the level of compactness and thus the size constraints lead to process inefficiencies.

Many systems employing a diffuser require the flow discharged from the diffuser to be substantially parallel to the axis of rotation of the impeller. Components must thus be provided to redirect the flow from the radial and tangential discharge directions to an axial direction. This is commonly achieved with ducts. Such ducts are undesirable because they occupy additional space and typically have a relatively large radius thus increasing the overall diameter of the diffuser. Ducts also lead to pressure losses that lower the efficiency of the diffuser. It is thus desired in the art to provide a centrifugal compressor diffuser that efficiently redirects the impeller discharge flow to an axial flow while maintaining compact overall dimensions. The diffuser should be able to effectively recover kinetic energy from all velocity components present in the impeller discharge flow.

Prior art diffusers employ a steady flow process to accomplish diffusion. The rate at which diffusion and direction changes can take place is limited by natural forces. As flow proceeds through a diffuser passage, the pressure along the passage increases by virtue of the diffusion that occurs along the passage. Concurrently, frictional and viscous forces cause a boundary layer of low energy fluid to develop along the solid surfaces of the diffuser passage. The growth rate of a boundary layer is accelerated by a pressure gradient.

Conditions adverse to effective diffusion result from boundary layer growth. First, boundary layers reduce the flow area available in a passage thus limiting the velocity reduction of the free stream. Second, the kinetic energy of fluid in the growing boundary layer is eventually reduced to the point that it cannot overcome the pressure gradient caused by diffusion. When this occurs, the boundary layer separates from one or more of the solid surfaces and significant pressure losses result. Depending on the structure of the separation, the flow may reverse direction over a portion of the passage and flow back into the impeller. Or, a separation bubble may form that contains recirculating fluid. Both events result in a loss of energy that would otherwise convert to a static pressure increase. The remaining outbound flow is forced through an even smaller flow area that further limits the diffusion that is accomplished. The separated flow eventually leads to a condition that precipitates compressor surge.

Prior design practice recognizes an optimum passage divergence angle of seven to eight degrees. This is a shallow angle that requires a relatively long passage to produce the area ratio needed for effective diffusion. Boundary layer thickness is also a function of passage length. A longer passage increases boundary layer loss. Longer passages also preclude a compact diffuser. A larger divergence angle can be used, but at the risk of causing flow separation. With such constraints in mind, most designers compromise between length and effectiveness. Such a compromise does not recover maximum kinetic energy from the flow.

Diffuser channel alignments and unrecovered kinetic energy result in a tangential component of velocity in the discharge flow. Some designs employ turning vanes in the discharge duct to recover some of this energy. However, boundary layers that develop along the additional tangential distance traveled by the flow, as well as on the turning vanes, cause additional losses.

A radial velocity is also present in a diffuser discharge flow. A duct is required to turn the radial flow to an axial direction for delivery to downstream components. The duct begins at the outermost radius of the diffuser and continues in a radial direction before turning to an axial direction. If the turn is too short, a flow separation will occur along the convex flow surface. More gradual turns require more radial distance working against the size constraint imposed on most diffusers. The gradual turns also produce additional loses as the flow travels through them. It is thus desired in the art to provide a diffuser that redirects the flow without such gradual turns and with reduced boundary layer formation.

SUMMARY OF THE INVENTION

In view of the foregoing, it is an objective of the present invention to provide a compact, efficient centrifugal compressor diffuser.

Another objective of the present invention is to provide a centrifugal compressor diffuser that efficiently delivers the discharge flow in a direction parallel to the axis of rotation of the impeller.

Another objective of the present invention is to provide a centrifugal compressor diffuser that discharges the flow at a relatively small radius.

Another objective of the present invention is to provide a centrifugal compressor diffuser that discharges the flow in an axial direction through an area having a maximum radius that is equal to or less than the maximum radius of the diffuser.

Another objective of the present invention is to provide a centrifugal compressor diffuser that efficiently recovers kinetic energy from all the velocity components present in the impeller discharge flow.

Another objective of the present invention is to provide a centrifugal compressor diffuser that brings all components of velocity present in the flow to rest in order to recover kinetic energy contained therein while maintaining an acceptable discharge flow rate.

Another objective of the present invention is to provide a centrifugal compressor diffuser that efficiently recovers kinetic energy from the flow to cause an increase in the static pressure of the discharged flow.

Another objective of the present invention is to provide a centrifugal compressor diffuser that employs an unsteady flow process to simultaneously diffuse and redirect the flow discharging from a centrifugal impeller.

Another objective of the present invention is to provide a centrifugal compressor diffuser that employs a valve to control the unsteady flow process by periodically closing the outlet chamber to trap the discharge flow and generate compression waves.

Another objective of the present invention is to provide a centrifugal compressor diffuser that employs a valve to control the unsteady flow process by periodically opening the outlet chamber to generate expansion waves and discharge the trapped flow.

Another objective of the present invention is to provide a centrifugal compressor diffuser that employs an unsteady flow process that limits boundary layer development in the diffuser.

These and other objectives and advantages of the invention are achieved by a diffuser for use with an impeller having an inlet and an outlet, the diffuser including a plurality of vanes disposed at the outlet of the impeller; a wave chamber disposed between adjacent vanes, each wave chamber having an inlet and an outlet; and a valve plate having at least one valve opening; the value opening selectively opening and closing the outlet of at least one wave chamber.

Other objectives and advantages of the invention are achieved by a method of diffusing a fluid flow delivered from the outlet of an impeller in a radial and tangential direction, the impeller rotating about an axis of rotation; the method including the steps of delivering the fluid flow from the outlet of the impellerto a plurality of wave chambers, each of the wave chambers having a maximum outer radius; and redirecting the fluid flow from the radial and tangential outlet directions to an axial direction substantially parallel with the axis of rotation within the wave chamber inside the maximum outer radius of the wave chamber.

BRIEF DESCRIPTION OF THE DRAWINGS

Preferred embodiments of the invention, illustrative of the best mode in which applicants have contemplated applying the principles of the invention, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 2:
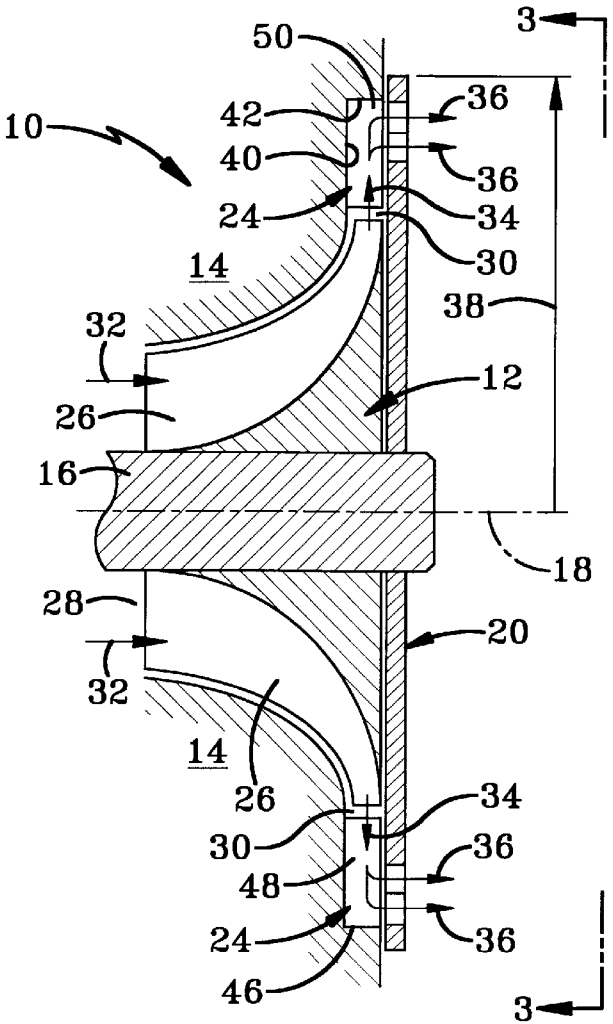
FIG. 2 is a sectional view taken along line 2—2 of FIG. 1 showing the valve plate of the present invention positioned immediately downstream of the impeller.
Figure 1:
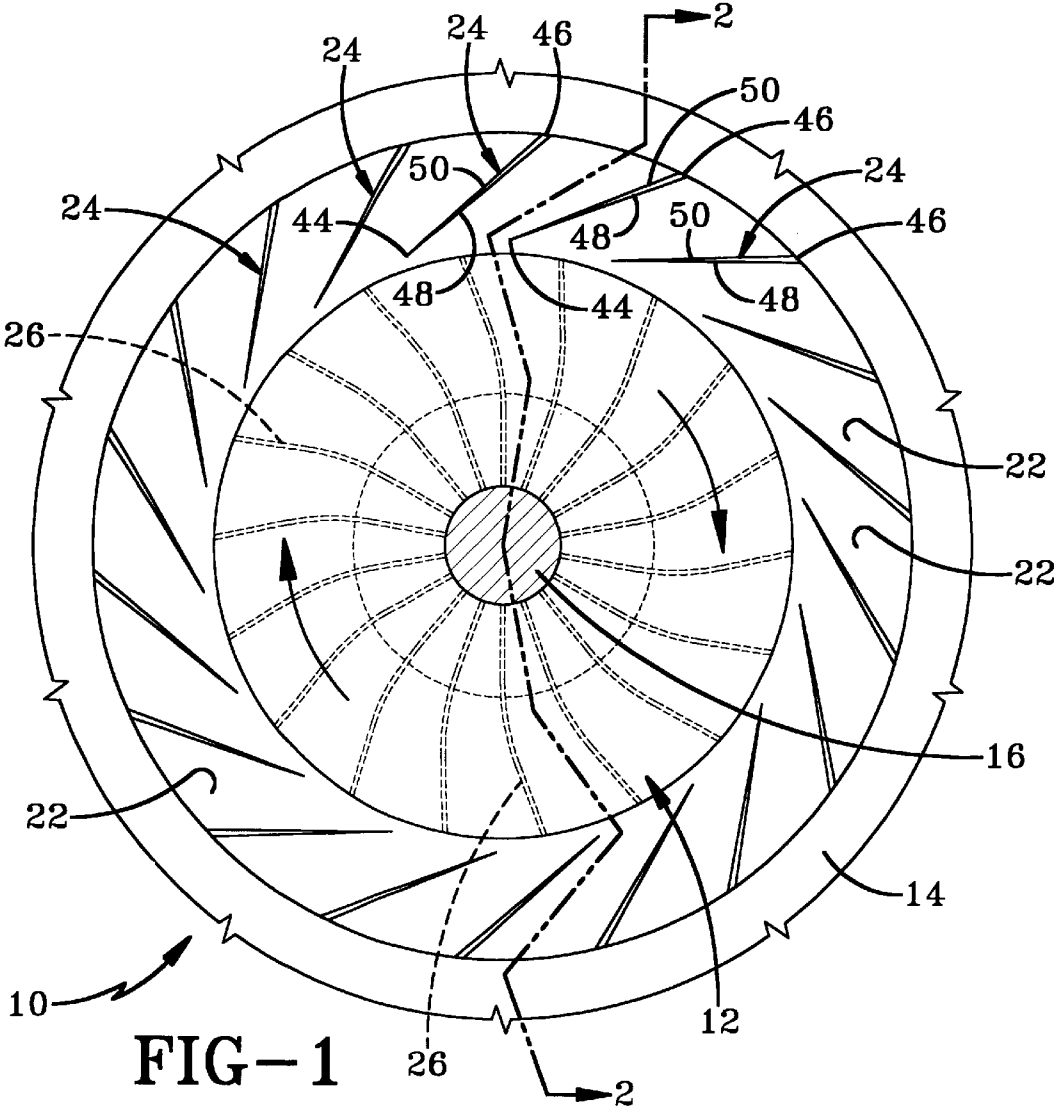
FIG. 1 is an elevational view of the diffuser of the present invention taken downstream of the impeller looking back upstream.
Figure 3:
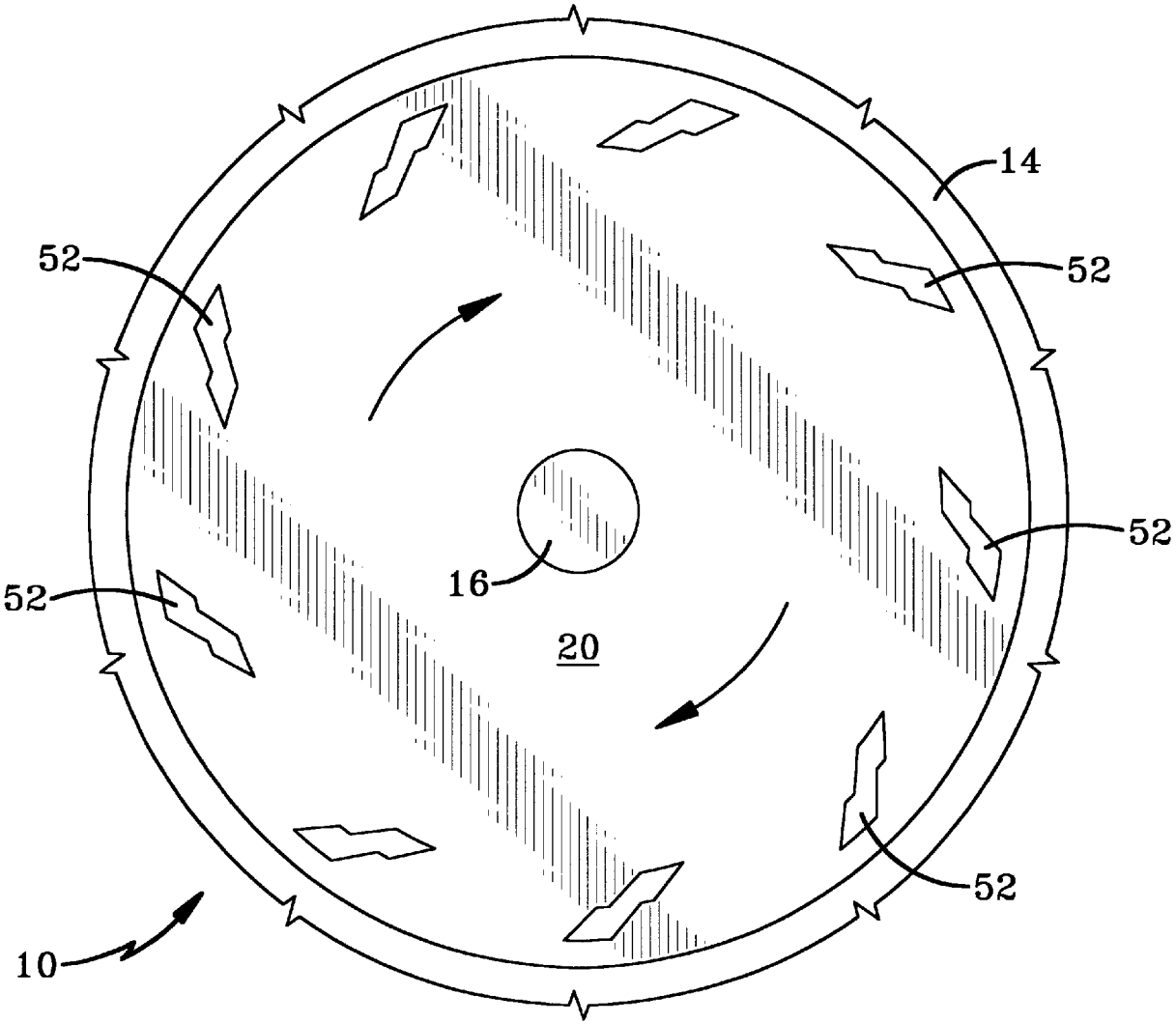
FIG. 3 is an elevational view taken along line 3—3 of FIG. 2.

The diffuser of the present invention is indicated generally by the numeral 10 in the accompanying drawings. Diffuser 10 surrounds the discharge of an impeller 12 rotatably disposed in a shroud 14. Impeller 12 is driven by a shaft 16 having an axis of rotation 18 located along the longitudinal centerline of shaft 16. A valve plate 20 is mounted on shaft 16 and rotates with shaft 16 and impeller 12. Diffuser 10 further includes a plurality of wave chambers 22 disposed at the outlet of impeller 12. Each wave chamber 22 is bounded by a pair of vanes 24. As will be discussed in detail below, diffuser 10 employs an unsteady flow process to simultaneously diffuse and redirect the flow discharging from impeller 12. The unsteady process occurs within wave chambers 22 and is controlled by valve plate 20 on the downstream side of each wave chamber 22. The preferred embodiment of the invention is described below to provide an example of the invention and the best mode in which the inventors now contemplate the invention. It should be understood, however, that the preferred embodiment and other embodiments described herein are only examples and that the components of diffuser 10 may be modified and altered depending on the specific application of diffuser 10.

Impeller 12 includes a plurality of blades 26 mounted on shaft 16 and arranged to draw fluid into impeller 12 at an inlet 28 and discharge the fluid at an outlet 30. The fluid is brought into impeller 12 in a flow direction that is substantially parallel to axis 18 as depicted by the arrow labeled with the numeral 32 in FIG. 2. Impeller blades 26 act on the fluid flow and impart kinetic energy to the flow. The flow exits impeller 12 at outlet 30 in a direction substantially perpendicular to axis 18 (with radial and tangential flow components) as indicated by the arrows labeled with the numeral 34 in FIG. 2. In accordance with one of the objectives of the present invention, diffuser 10 redirects outlet flow 34 from a direction substantially perpendicular to axis 18 to a direction substantially parallel with axis 18 as depicted by the arrows labeled with the numeral 36 in FIG. 2. In accordance with another objective of the present invention, diffuser 10 accomplishes the redirection of flow in an area that is less than the outer radius 38 of diffuser 10. This configuration results in a compact diffuser that increases the pressure of the flow while redirecting the flow in a desired direction.

Outlet 30 of impeller 12 is surrounded circumferentially by wave chambers 22. Each wave chamber 22 is thus disposed radially outwardly of outlet 30. Each wave chamber 22 is bounded by vanes 24, valve plate 20, and a solid surface such as shroud 14. In the embodiment of the invention depicted in the drawings, shroud 14 extends radially outwardly from impeller 12 to form the shroud surface 40 of each wave chamber 22 and the outer radial surface 42 of each wave chamber 22. In other embodiments of the present invention, other structures may form surfaces 40 and 42.

Each vane 24 may be flat, wedge shaped, or curved as required in a specific application of diffuser 10. In the embodiment of the invention depicted in the exemplary drawings, each vane 24 is wedge shaped and includes a leading edge 44 and a trailing edge 46. Each vane 24 thus provides a suction side 48 for one chamber 22 and a pressure side 50 to the adjacent chamber 22. Suction and pressure sides 48 and 50 diverge not only to create wedge shaped vanes 24 but also to increase the area along each wave chamber 22 as the radius increases. In accordance with one of the objectives of the present invention, each wave chamber 22 is bounded by outer radial surface 42 that prevents flow in wave chambers 22 from exiting wave chamber 22 in a radial direction. In the past, flow from chambers 22 would typically exit in a radial direction. In diffuser 10 of the present invention, flow exits each wave chamber 22 in a direction substantially parallel to axis 18 of impeller 12.

The outlet of fluid from each wave chamber is controlled by valve plate 20 which includes a plurality of valve openings 52. In the embodiment of the invention depicted in the drawings, valve plate 20 includes one valve opening 52 for every two wave chambers 22. For instance, diffuser 10 includes eighteen wave chambers 22 and nine valve openings 52. In accordance with one of the objectives of the present invention, valve plate 20 rotates with impeller 12 to selectively open and close the outlet to each wave chamber 22. The outlet to a wave chamber 22 is considered to be open when a valve opening 52 is disposed between the vanes 24 of that wave chamber 22 and in fluid communication with wave chamber 22. The outlet to wave chamber 22 is considered to be closed when no valve opening 52 is in fluid communication with wave chamber 22. For instance, of the pair of wave chambers depicted in the center of FIG. 4A, chamber 54 is presently open and chamber 56 is presently closed. Other embodiments of the invention may contain a ratio of the number of wave chambers 22 to the number of valve openings 52 that is different from the two-to-one ratio depicted in the drawings.

Valve plate 20 controls the unsteady flow process by periodically closing wave chambers 22 to trap flow and to generate compression waves within chamber 22. Valve plate 20 then opens chamber 22 to generate an expansion fan and to discharge flow from wave chamber 22. In operation, flow proceeds from impeller 12 into wave chamber 22 where it stagnates against outer radial surface 42 creating a reflected compression wave in chamber 22. The reflected compression wave moves upstream toward impeller 12 bringing the incoming flow to rest. Valve plate 20 then rotates valve opening 52 into fluid communication with wave chamber 22 and an expansion fan is created to begin discharging the trapped fluid in the direction of the expansion. The size and location of valve openings 52 are configured to cause cancellation of compression and expansion waves before pressure perturbations reach impeller 12. Multiple compression and expansion waves produced by rapid cycling of the valve during the operation of diffuser 10 generates a wave pattern that continually diffuses the flow and redirects the flout to axial direction 36. This flow pattern limits the development of boundary layers that adversely influence the flow through diffuser 10. The configuration of diffuser 10 also allows the flow to be redirected to axial direction 36 from radial and tangential directions 34 in a compact diffuser.

Figure 8:
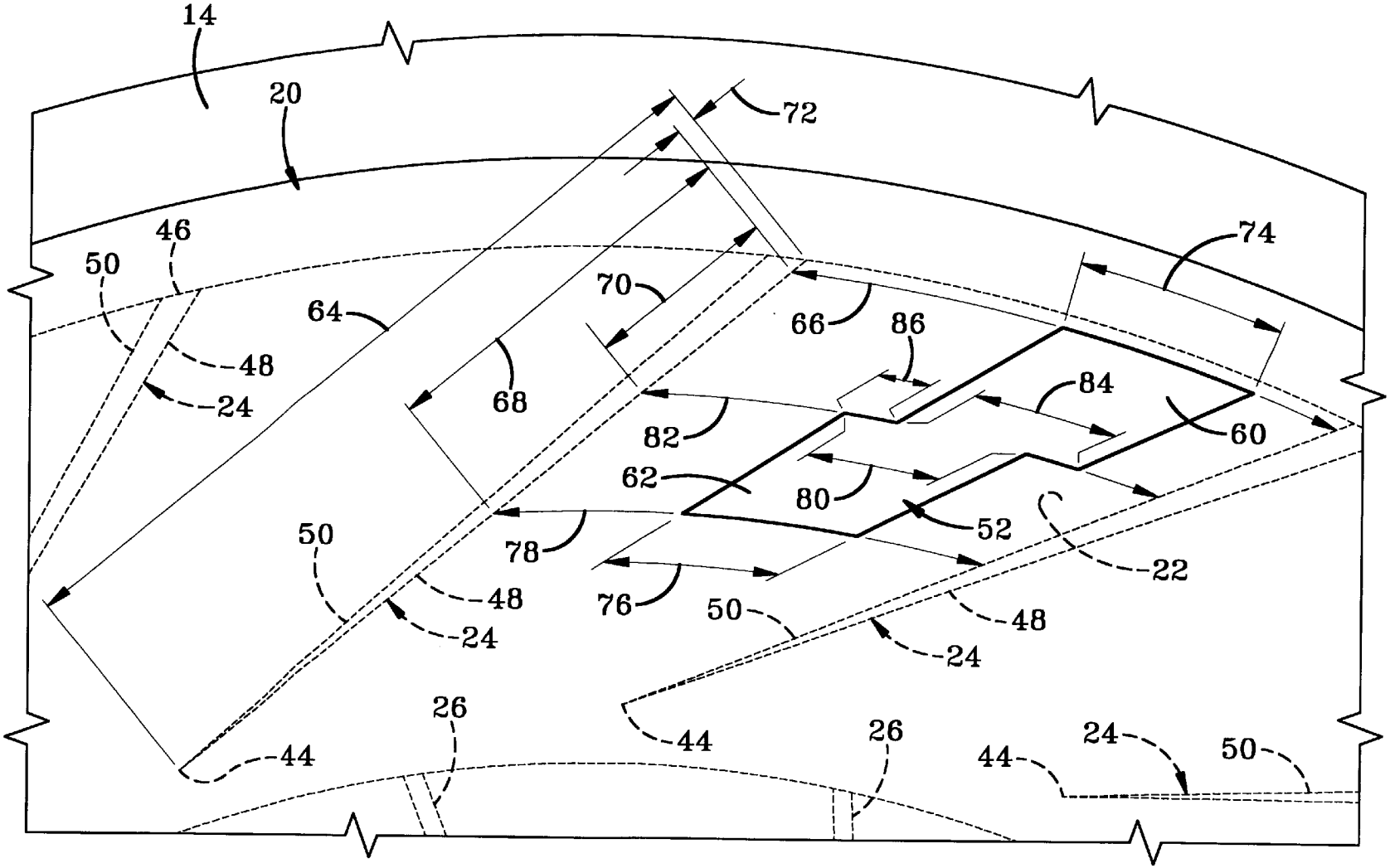
FIG. 8 is an enlarged elevational view of one of the valve openings of the valve.
Figure 9:
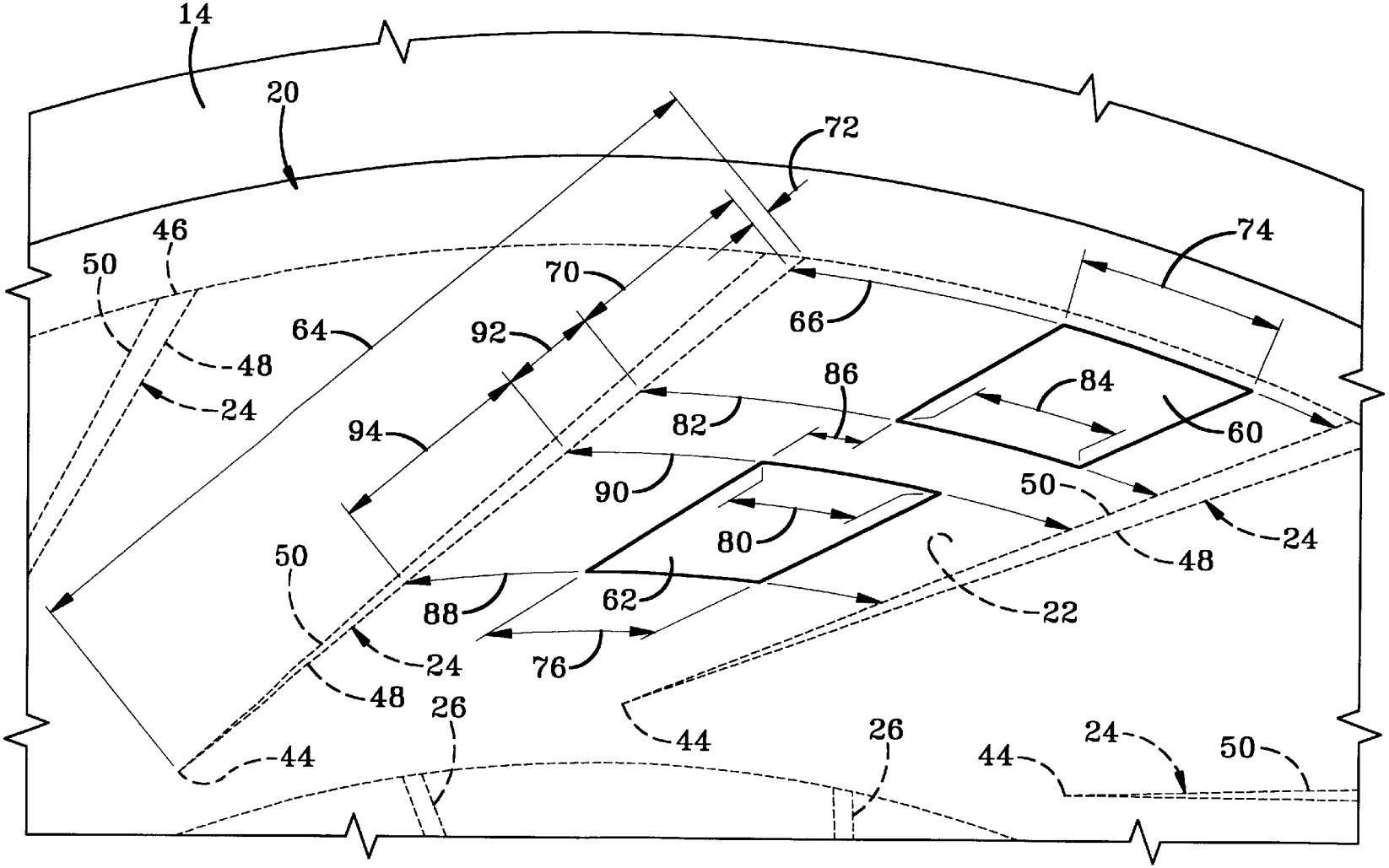
FIG. 9 is a view similar to FIG. 8 showing a first alternative embodiment of the valve openings.
Figure 10:
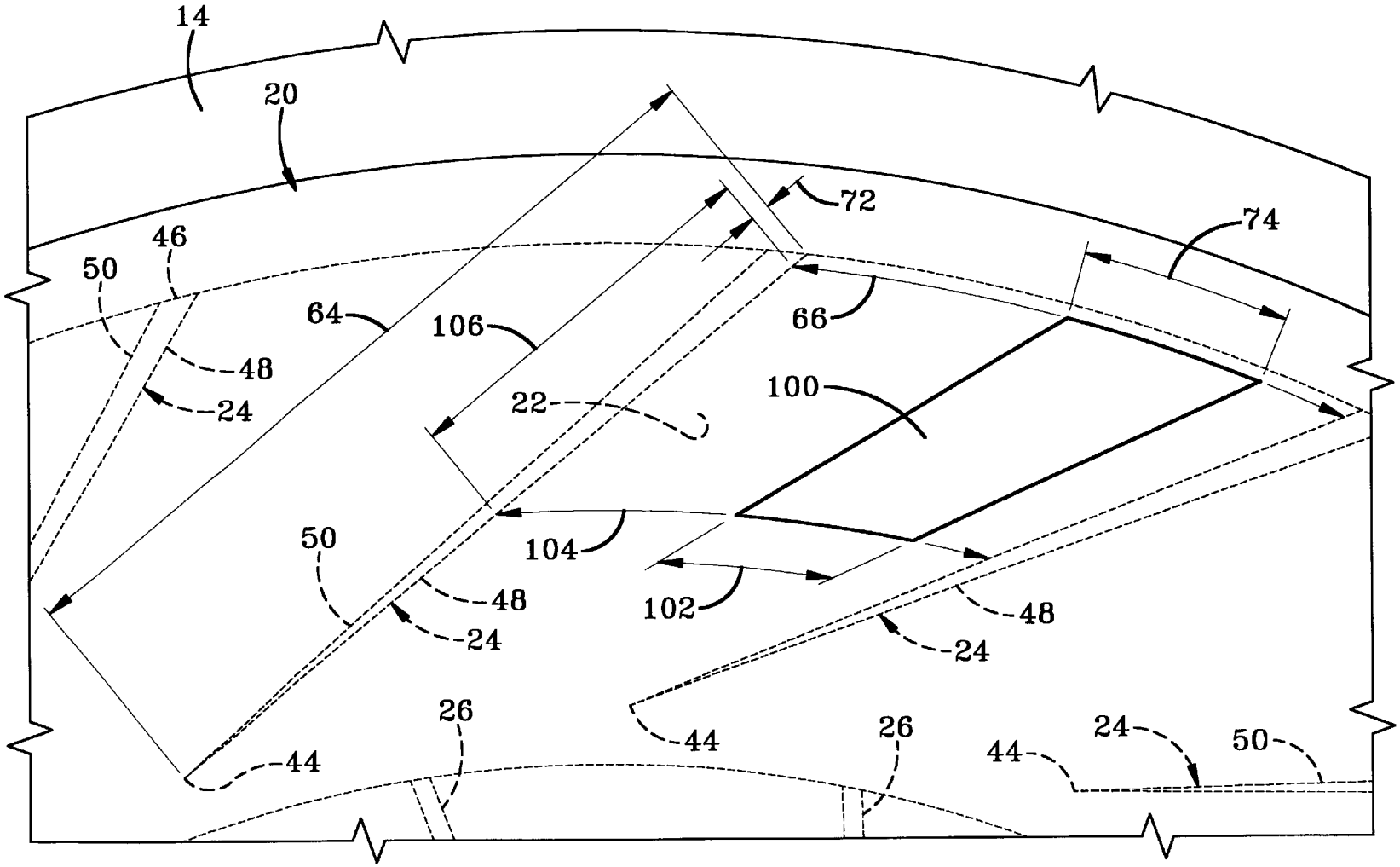
FIG. 10 is a view similar to FIGS. 8 and 9 showing a second alternative embodiment of the valve openings.

For purposes of example, three alternative valve opening configurations are depicted in FIGS. 8, 9, and 10. It is understood that a wide variety of valve openings 52 may be used and the specific examples provided in FIGS. 8–10 are not to limit the present invention. In the embodiment of the valve opening depicted in FIG. 8, valve opening 52 is an offset design having an upper portion 60 and a lower portion 62. Upper and lower portions 60 and 62 are connected together to form single valve opening 52. Each valve opening 52 is sized as follows. First, the overall length 64 of vane 24 is determined. Next, the overall width 66 of wave chamber 22 taken at its greatest radius is determined. Valve opening 52 is then sized by setting its overall length 68 equal to 0.48 of overall length 64 and the length 70 of upper portion 60 equal to 0.24 of overall length 64. Opening 52 is also offset by a distance 72 from the maximum radius of wave chamber 22. Offset 72 is determined by the specific application of diffuser 10. The width 74 of upper portion 60 may be 0.38 of overall width 66 with the 0.38 factor carried on throughout the length of opening 52 such that width 76 is 0.38 of width 78 and widths 80 and 84 are 0.38 of width 82. In the embodiment of valve opening 52 depicted in FIG. 8, upper portion 60 leads lower portion 62 by 1.94°. The offset dimension 86 is the circumferential equivalent of 1.94° of an arc at the radius of width 84.

In the embodiment of valve opening 52 depicted in FIG. 9, upper portion 60 and lower portion 62 are not connected and form individual openings in valve plate 20. In this embodiment, upper portion 60 also leads lower portion 62. Openings 60 and 62 may be dimensioned similarly to the embodiment depicted in FIG. 8 except that widths 76 and 80 are now 0.38 of widths 88 and 90, respectively. The dimensions 88 and 90 are determined by appropriate calculations depending on the specific application of diffuser 10. Similarly, the remaining length dimensions 92 and 94 are calculated by the designer of diffuser 10.

A second alternative valve opening is depicted in FIG. 10 and indicated generally by the numeral 100. Valve openings 100 form a plurality of valve openings in valve plate 20 and are sized according to the design principles; of diffuser 10 for a particular application. For instance, width 74 of opening 100 may be the 0.38 factor discussed above with respect to FIG. 8 or may be another factor. The lower width 102 is some factor of the overall width 104 and the overall length 106 of opening 100 is some factor of length 64.

It is understood that openings 52 and 100 may have a wide variety of configurations and are not to be limited by the specific embodiments shown and described herein for purposes of example. The configuration and dimensions of openings 52 and 100 are sized and selected depending on the specific application of diffuser 10. Design factors will include the conditions of the fluid flowing through diffuser 10, the speed of impeller 12, and the dimensions of impeller 12 and wave chambers 22.

Turning now to FIGS. 4A–7B, the operation of diffuser 10 is now discussed with respect to one embodiment of the invention. Wave chamber 22 is closed by valve plate 20 in FIG. 4A. Outlet flow 34 from impeller 12 thus fills wave chamber 56 and stagnates against outer radial surface 42 and the pressure builds in wave chamber 22. A reflected compression wave moves upstream as indicated by the arrow labeled by numeral 120 in FIG. 4B. Compression wave 120 brings incoming flow 34 to rest. The fluid downstream of compression wave 120 is at rest and therefore absent of boundary layers.

Figure 5B:
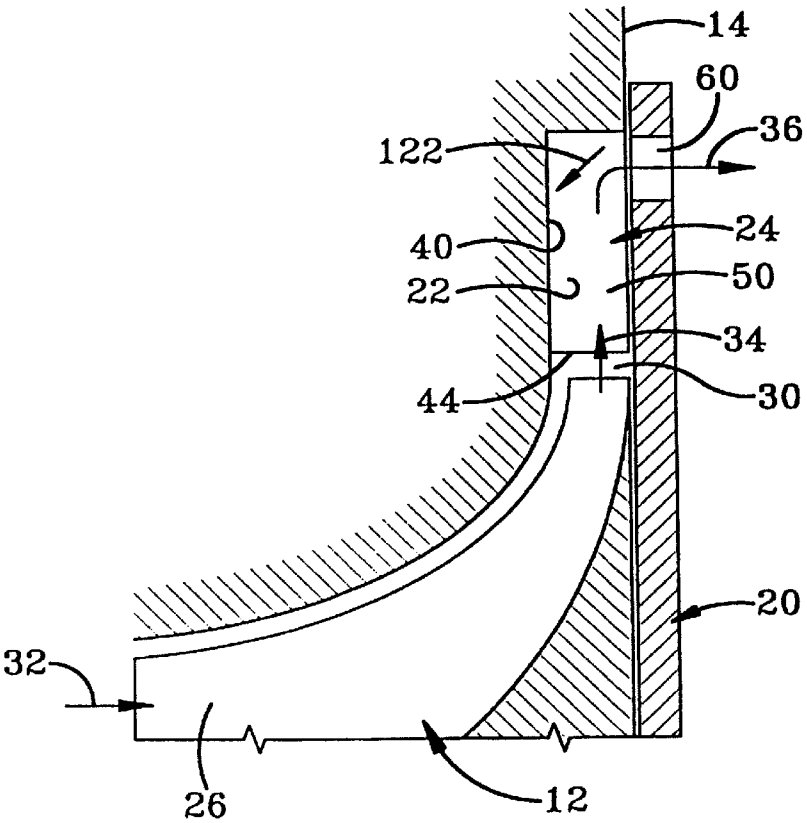
FIG. 5B is a sectional side view taken along line 5B—5B of FIG. 5A.
Figure 5A:
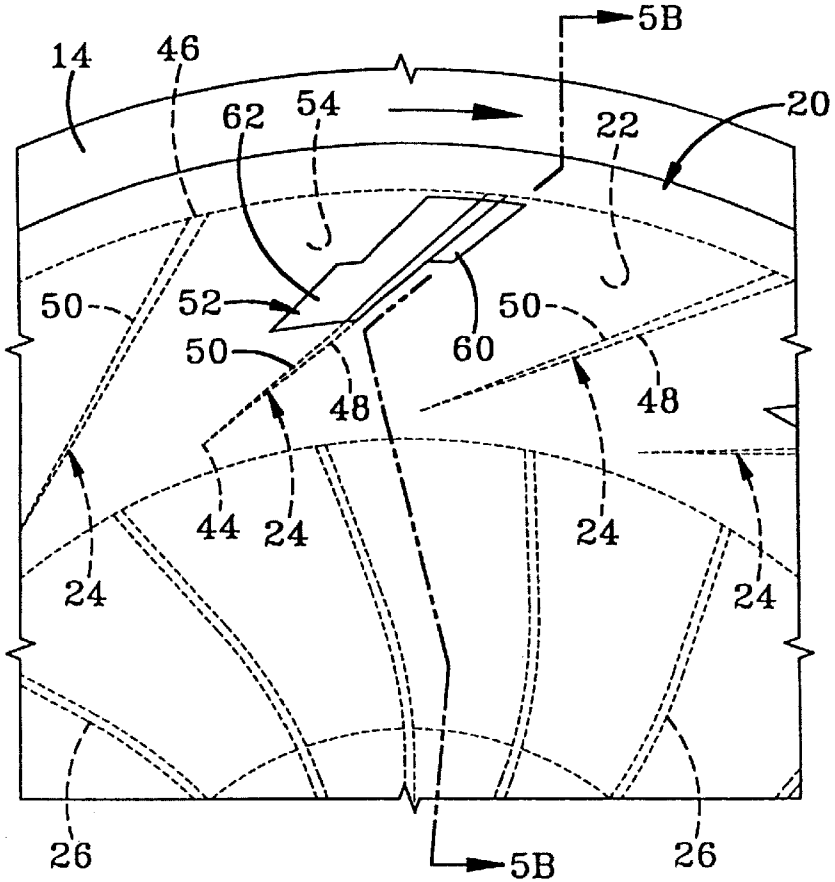
FIG. 5A is a view similar to FIG. 4A showing the valve in an initial open position.

Valve plate 20 continues to rotate bringing upper portion 60 of valve opening 52 into fluid communication with wave chamber 22 as shown in FIGS. 5A and 5B. An expansion fan 122 begins to form at the outer radial portion of wave chamber 56 to begin discharging trapped fluid in the direction of the expansion through upper portion 60 of valve opening 52.

Figure 6B:
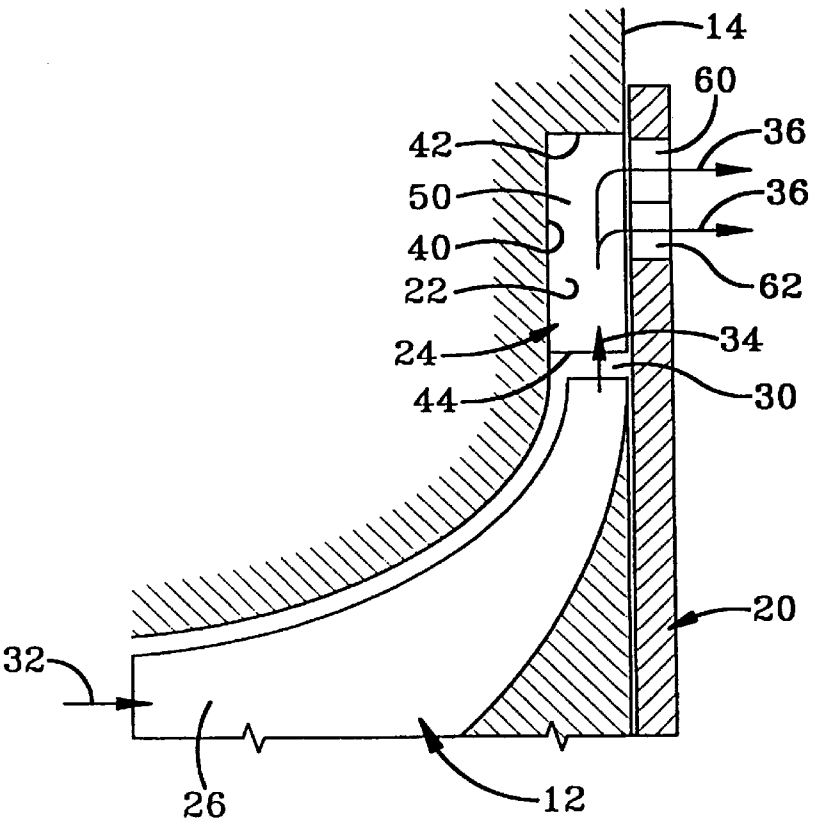
FIG. 6B is a sectional side view taken along line 6B—6B of FIG. 6A.
Figure 6A:
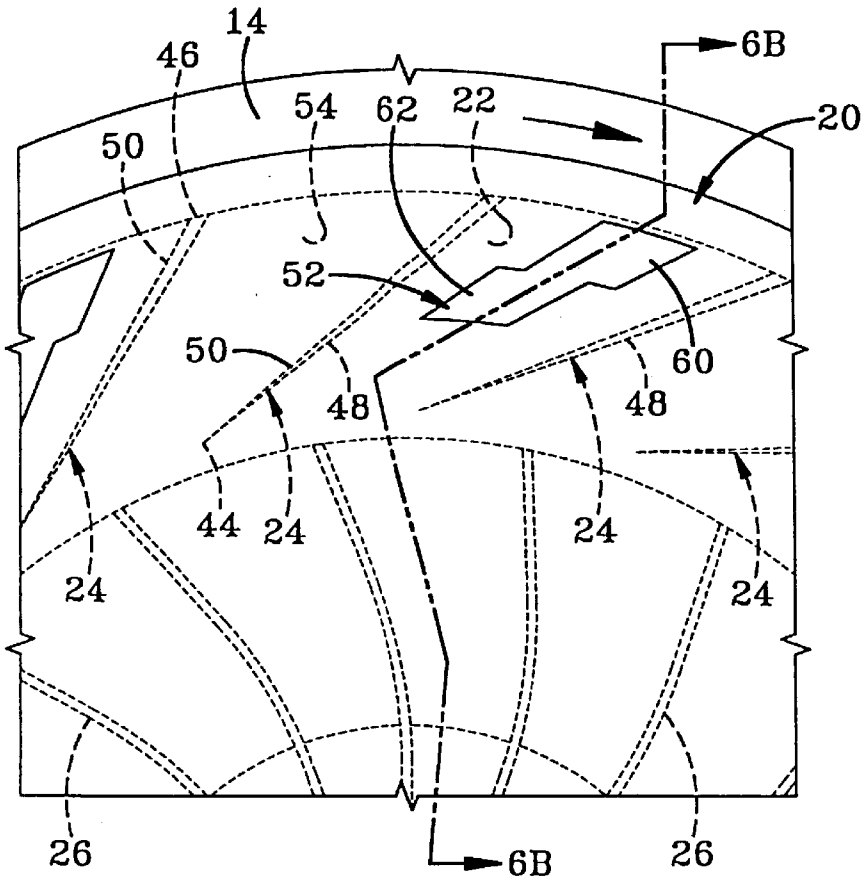
FIG. 6A is a view similar to FIG. 4A showing the valve in a fully open position.

Valve plate 20 continues to rotate as depicted in FIGS. 6A and 6B bringing the entire valve opening 52 into communication with wave chamber 22. Expansion fan 122 is now fully developed allowing complete discharge of the flow in the axial direction 36.

Figure 4B:
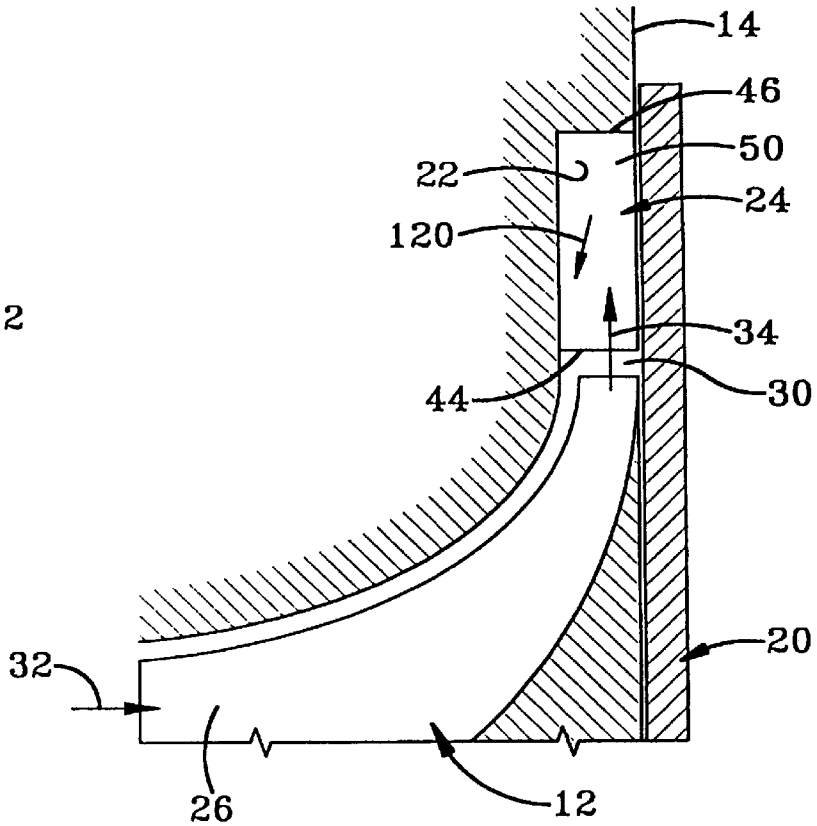
FIG. 4B is a sectional side view taken along 4B—4B of FIG. 4A.
Figure 4A:
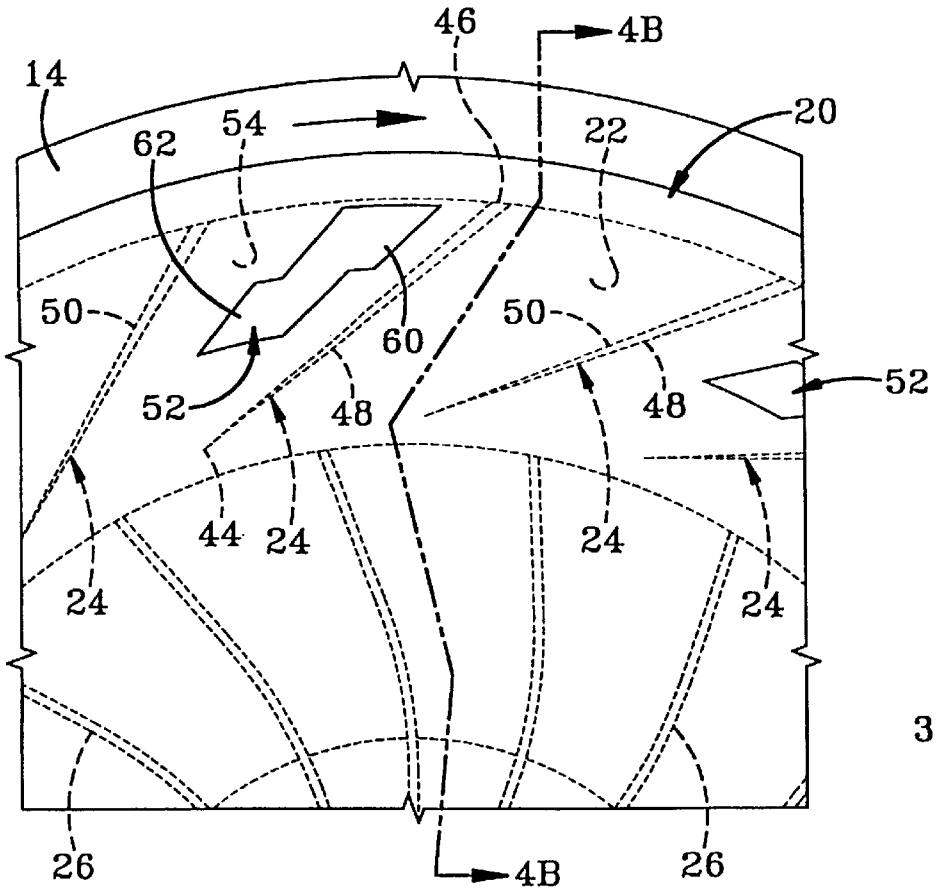
FIG. 4A is an enlarged elevational view of a portion of the diffuser showing a pair of adjacent wave chambers in the center of the figure; the valve in a closed position with respect to the right hand chamber of the pair.
Figure 7B:
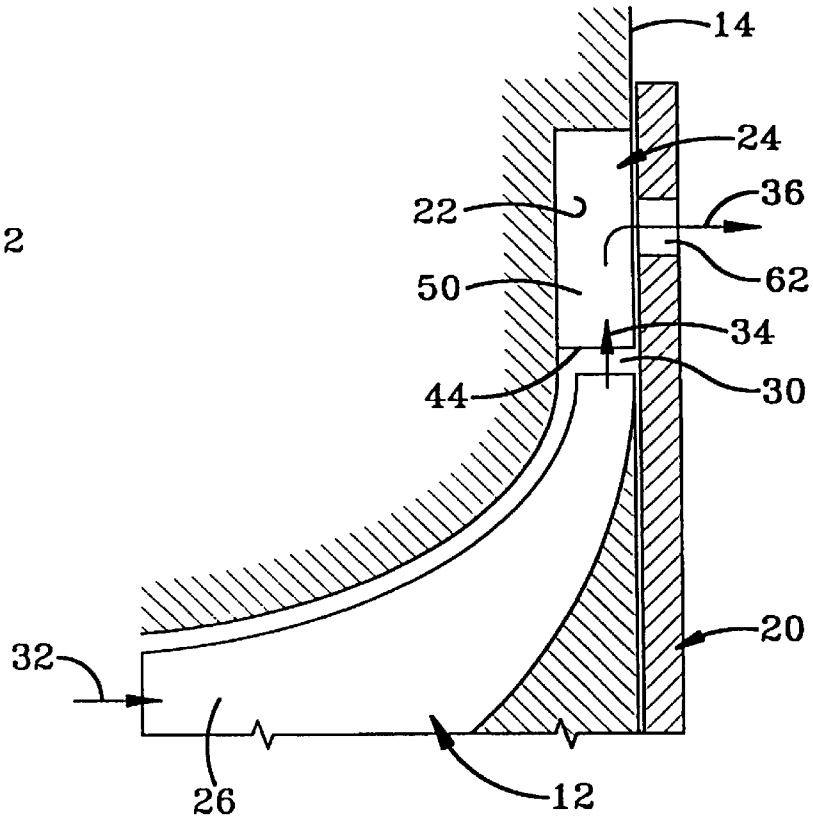
FIG. 7B is a sectional side view taken along line 7B—7B of FIG. 7A.
Figure 7A:
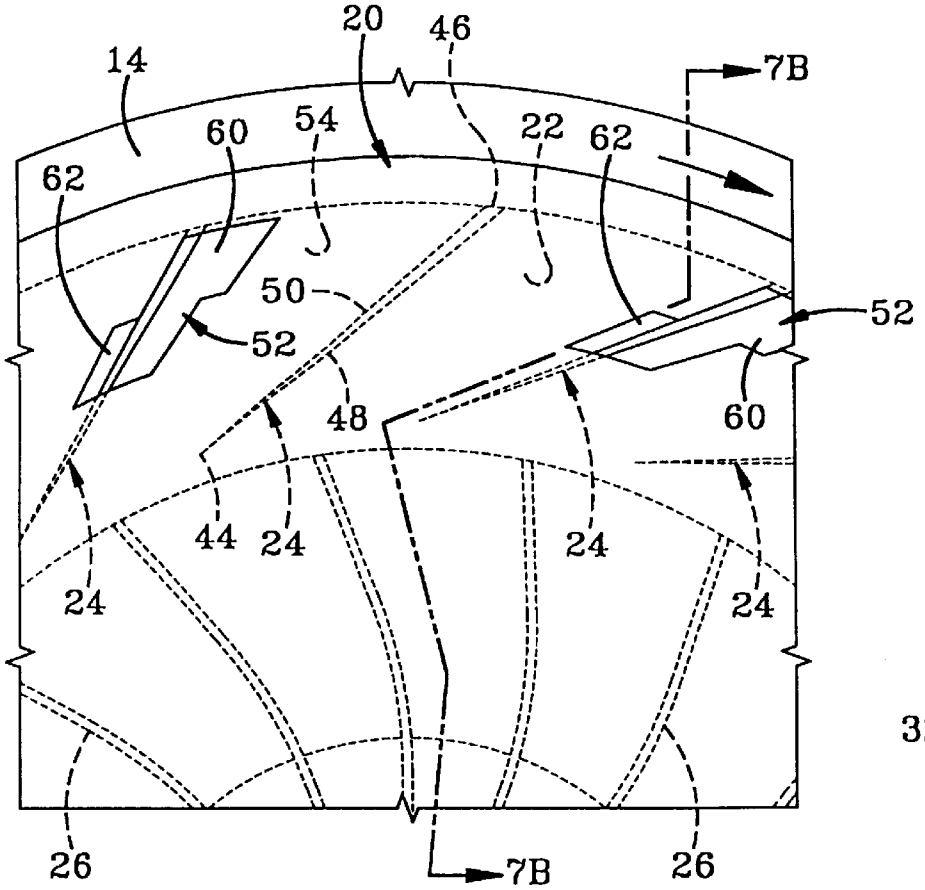
FIG. 7A is a view similar to FIG. 4A showing the valve in its final open position.

FIGS. 7A and 7B depict the end of the cycle where upper portion 60 has moved out of wave chamber 22 but lower portion 62 is still in fluid communication with wave chamber 22. The fluid communication between lower portion 62 continues to allow fluid to escape from wave chamber 22 until valve plate 20 rotates farther to close wave chamber 22 as depicted in FIGS. 4A and 4B.

This cycle creates an unsteady flow through diffuser 10 to simultaneously accomplish diffusion and flow redirection. The flow that enters each wave chamber 22 is temporarily brought to rest by the action of the waves. Kinetic energy is recovered from all components of the flow and only kinetic energy needed to be deliver flow to downstream components is reintroduced into the fluid. Immediate axial delivery of the flow directly from diffuser 10 is made possible by the virtue of the fact that the fluid within chamber 22 is at rest and may be reaccelerated in any direction. The ducting that is normally required to return the flow through a gradual bend is thus eliminated. Recovery of residual swirl in the duct is also not needed because the component has been fully recovered in wave chamber 22. The elimination of the radial ducting prevents pressure loss that occurs within the ducting and improves the compactness of diffuser 10. Boundary layer development in diffuser 10 is limited by the periodic nature of flow through wave chamber 22. Even though a boundary layer will begin to develop as flow enters wave chamber 22, the boundary layer collapses when the fluid in wave chamber 22 is brought to rest against a closed portion of valve plate 20. The same occurs during the discharge process. The loss is attributed to boundary layergrowth in diffuser 10 are thus lower than a steady flow diffuser.

Valve plate 20 operates in close proximity to wave chambers 22 to minimize leakage. Wave chamber 22 may also be sealed by any of a variety of seals known in the art such as labyrinth seals or face seals. Valve plate may be driven by impeller shaft 16 as depicted in the drawings or may be driven by a separate drive mechanism. It is also contemplated that a different valve assembly or multiple valve assemblies may be utilized to create the unsteady flow process instead of rotating valve plate 20. Non-rotary valves may also be used to control the wave process. Alternate constructions of wave chambers 22 similar to the chambers of other steady flow diffuser types may also be used with the valves to create the unsteady flow. Other embodiments may also include a valve member that controls the wave chamber volume during the cycling of the valve. It is also contemplated that fuel may be injected into the wave chambers to produce combustion within the wave chambers during the cycling of the valves.

Accordingly, the improved wave augmented diffuser for centrifugal compressors is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved wave augmented diffuser for centrifugal compressors is construed and used, the characteristics of the construction, and the advantageous, new and useful results obtained; the new and useful structures, devices, elements, arrangements, parts and combinations, are set forth in the appended claims.

What is claimed is:

1. A diffuser for use with an impeller having an inlet and an outlet, the diffuser comprising:

a plurality of vanes disposed at the outlet of the impeller;

a wave chamber disposed between adjacent vanes, each wave chamber having an inlet and an outlet; and a valve plate having at least one valve opening; the valve opening selectively opening and closing the outlet of at least one wave chamber.

2. The diffuser of claim 1, wherein the valve plate rotates with respect to the wave chambers.

3. The diffuser of claim 2, further comprising a drive shaft; the valve plate mounted on the drive shaft with the impeller adapted to be mounted on the drive shaft such that the valve plate and impeller rotate together.

4. The diffuser of claim 1, wherein the valve plate includes one valve opening for every two wave chambers.

5. The diffuser of claim 1, wherein each valve opening includes an outer portion and an inner portion.

6. The diffuser of claim 5, wherein each outer portion of the valve opening is offset from the inner portion of the valve opening.

7. The diffuser of claim 6, wherein the outer portion and inner portion of each valve opening are connected to form a single opening.

8. The diffuser of claim 6, wherein the outer portion and inner portion of each valve opening are separated from each other to form two individual openings.

9. A diffuser for use with an impeller having an inlet and an outlet, the impeller rotating about an axis of rotation, the inlet to the impeller accepting a fluid flow substantially parallel to the axis of rotation, the fluid flow passing through the outlet in a direction substantially perpendicular to the axis of rotation; the diffuser comprising:

a plurality of vanes disposed at the outlet of the impeller;

a wave chamber disposed between adjacent vanes, each wave chamber having a maximum outer radius;

each wave chamber having an inlet aligned with the outlet to the impeller;

each wave chamber further having an outlet substantially perpendicular to the inlet of the wave chamber; the outlet having a maximum outer radius;

the maximum radius of the outlet being no greater than the maximum outer radius of the wave chamber; and a valve selectively opening and closing the outlet to the wave chamber.

10. The diffuser of claim 9, wherein the valve is a valve plate having at least one valve opening; the valve plate rotating with respect to the wave chamber.

11. A method of diffusing a fluid flow in a centrifugal compressor, comprising the steps of:

delivering a fluid flow to the input of the impeller of the diffuser, the fluid flow traveling in an input direction axial to the impeller;

imparting kinetic energy to a fluid flow with the impeller;

turning the fluid flow with the impeller from the axial direction to a radial outlet direction substantially perpendicular to the input direction;

delivering the fluid flow from the impeller to a plurality of wave chambers, each of the wave chambers having a maximum outer radius; and wherein each wave chamber has an outlet;

providing a valve in communication with the outlet to each wave chamber and opening and closing the outlet of each wave chamber with the valve;

stalling the fluid flow in the wave chamber;

redirecting the fluid flow from the radial outlet direction to an axial direction within the wave chamber inside the maximum outer radius of the wave chamber.

12. The method of claim 11, further comprising the step of increasing the pressure of the fluid flow while the step of stalling the fluid flow occurs.

13. A method of diffusing a fluid flow delivered from the outlet of an impeller in a radial and tangential direction, the impeller rotating about an axis of rotation; the method comprising the steps of:

delivering the fluid flow from the outlet of the impeller to a plurality of wave chambers, each of the wave chambers having an inlet and an outlet; and selectively opening and closing the outlets of the wave chambers.

14. The method of claim 13, further comprising the step of creating a compression wave in the fluid in a wave chamber when the outlet of the wave chamber is closed.

15. The method of claim 13, further comprising the step of creating an expansion fan in the fluid in a wave chamber when the outlet of the wave chamber is open.

* * * * *